US006241013B1

(12) United States Patent
Martin

(10) Patent No.: US 6,241,013 B1
(45) Date of Patent: Jun. 5, 2001

(54) ONE-TRIP SQUEEZE PACK SYSTEM AND METHOD OF USE

(75) Inventor: William J. Martin, Carencro, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/139,476

(22) Filed: Aug. 25, 1998

(51) Int. Cl.[7] ..... E21B 43/04
(52) U.S. Cl. ..... 166/51; 166/114; 166/278
(58) Field of Search ..... 166/278, 114, 166/51, 276

(56) References Cited

U.S. PATENT DOCUMENTS

| | | | | |
|---|---|---|---|---|
| 2,942,664 | * | 6/1960 | Burns | 166/51 |
| 3,032,117 | * | 5/1962 | Tausch et al. | 166/184 |
| 3,963,076 | * | 6/1976 | Winslow | 166/278 |
| 4,105,069 | * | 8/1978 | Baker | 166/51 |
| 4,635,725 | * | 1/1987 | Burroughs | 166/278 |
| 4,944,348 | * | 7/1990 | Whiteley et al. | 166/278 |
| 4,951,750 | * | 8/1990 | Wetzel, Jr. | 166/278 |
| 5,327,960 | * | 7/1994 | Cornette et al. | 166/51 |
| 5,505,260 | * | 4/1996 | Anderson et al. | 166/278 |
| 5,845,712 | * | 12/1998 | Griffith, Jr. | 166/278 |
| 5,865,251 | * | 2/1999 | Rebardi et al. | 166/278 |
| 5,931,229 | * | 8/1999 | Lehr et al. | 166/278 |

OTHER PUBLICATIONS

Otis Engineering Corporation, *Otis Sand Control—Gravel Pack Systems Technical Information*, 1991, (Section VII), vol. VI, Dallas, Texas.

Haliburton Energy Services, Inc., *Sand Control Products and Services*, 1997, U.S.A.

Otis Engineering Corporation, *Otis Sand Control—Multi-Position Gravel Pack System*, 1990, U.S.A.

Otis Engineering Corporation, *Otis Sand Control—Equipment and Services*, 1991, U.S.A.

Otis Engineering Corporation, *General Sales Catalog*, 1985, (pp. 17, 18, 47–112), OEC 5338, U.S.A.

Don Shepherd, et al., Frac Packing Using Conventional and Alternative Path Technology, 1998, Society of Petroleum Engineers SPE 39478, U.S.A.

C.M. Ross, Absolute Isolation System Facilitates Successful Post–Gravel–Pack Isolation: Case Histories, 1994, Society of Petroleum Engineers SPE 27894, U.S.A.

Otis Engineering Corporation, *Otis Products and Services Catalog*, No Date, (pp. 78–90), U.S.A.

Otis Engineering Corporation, *Otis Sand Control—Sand Control Systems*, 1993, (Section III), U.S.A.

K.R. Powell, et al., Productivity Performance Comparison of High Rate Water Pack and Frac–Pack Completion Techniques, 1997, Society of Petroleum Engineers SPE 38592, U.S.A.

* cited by examiner

*Primary Examiner*—David Bagnell
*Assistant Examiner*—Jennifer R. Dougherty
(74) *Attorney, Agent, or Firm*—William M. Imwalle; David W. Carstens

(57) ABSTRACT

A one-trip squeeze pack system has a unique service seal unit design using concentric tubing, with the inner tubing an extension of the traditional wash pipe and is later used as the production tubing. The inner tubing contains a ported sub which can be isolated in various positions within the outer tubing by way of seals located above and below the ported sub. This seal unit is raised and lowered on the production string and isolated at various positions in order to accomplish setting the packer, running a packing job, reversing out packing fluid, and receiving production fluids.

25 Claims, 4 Drawing Sheets

ONE-TRIP SQUEEZE PACK SYSTEM AND METHOD OF USE

TECHNICAL FIELD OF THE INVENTION

The present invention relates to a one-trip squeeze pack system used in gravel pack, frac pack, and similar applications in oil field wells. Specifically, the present invention allows for gravel pack, frac pack, or similar assemblies to be run on the production string, thus eliminating the need for a separate trip down the well with a work string.

BACKGROUND OF THE INVENTION

Gravel pack assemblies and frac pack assemblies are commonly used in oil field well completions. A frac pack assembly is used to stimulate well production by using liquid under high pressure pumped down a well to fracture the reservoir rock adjacent to the wellbore. Propping agents suspended in the high-pressure liquid (in hydraulic fracturing) are used to keep the fractures open, thus facilitating increased flow rates into the wellbore. Gravel pack completions are commonly used for unconsolidated reservoirs and for sand control. Gravel packs can be used in open-hole completions or inside-casing applications. An example of a typical gravel pack application involves reaming out a cavity in the reservoir and then filling the well with sorted, loose sand (referred to in the industry as gravel). This gravel pack provides a consolidated sand layer in the wellbore and next to the surrounding reservoir producing formation, thus restricting formation sand migration. A slotted or screen liner is run in the gravel pack which allows the production fluids to enter the production tubing while filtering out the surrounding gravel.

A typical gravel pack completion is illustrated in FIG. 1. FIG. 1 is a schematic representation showing a perforated wellbore annulus 2, with perforation shown extending into the zone of interest 5. Within the wellbore annulus 2 a tube 4 has been placed on which is attached a screen 6. The gravel 3 is shown packed into the perforations in the zone of interest 5 and surrounding the screen 6. The gravel 3 is an effective filter of formation fluids, because the formation sand which flows with the production fluid is largely trapped in the interstices of the gravel.

One specific type of gravel pack procedure is called a squeeze gravel pack. The squeeze gravel pack method uses high pressure to "squeeze" the carrier fluid into the formation, thereby placing gravel in the perforation tunnels of a completed well and the screen/casing annulus. The frac pack method is very similar, except the "squeeze" is carried out at even higher pressures with more viscous/heavier fluid in order to fracture the reservoir rock. Consequently, the downhole assembly used for these two procedures is frequently the same.

Typical gravel pack or frac pack assembly is presently run into the well on a work string. The work string is a length of drill pipe normally removed from the well once the packing job is complete. The work string assembly also contains a setting tool for the packer and a crossover tool to redirect the treatment from within the work string into the formation. This assembly usually requires a setting ball to be dropped from the surface which must fall to a seat on the assembly. The setting ball actuates the setting tool and "sets" the packer, thus isolating the assembly from the upper wellbore. In some applications it establishes the crossover in the crossover tool as well. It sometimes occurs in these prior art applications that the ball is lost or damaged. Seat damage and/or debris may also cause seating problems. Further, it takes time for the ball to fall. Most importantly, the setting and crossover tools must be pulled from the well before the seal assembly and tubing may be run. This means the entire work string is removed from the well and a separate production string, through which the production fluids or gases will flow, is then landed back in the well. All this takes considerable rig time and adds to the expense of the completion. This additional time may also expose the well to fluid losses and result in formation damage. Rental and redress fees are usually charged for the use of these tools which adds to the expense of the job.

A need exists, therefore, for a gravel pack, frac pack and like assembly systems that can be run into the well on a work string that will also act as the production string (a "one-trip" assembly). This would eliminate the need for a separate work string to be run in and out of the well and save considerable rig time while greatly reducing sealing problems encountered under the present art.

SUMMARY OF THE INVENTION

The present invention relates to an improved gravel pack, frac pack, and like assemblies that can be run into the well on production tubing, thus saving one trip with a work string and avoiding seating problems inherent with prior art methods and assemblies. Because of the invention design, there is no setting tool required. The setting mechanism is within the invention's packer. There is no cross-over tool required either. The gravel pack cross-over is an integral part of the service seal unit which is run in with the assembly and remains in the well. The design of the system combined with the fact that the system is run on production tubing makes the chance of sealing problems or disrupting the setting of the packer negligible.

Unlike the prior art, the packing components of the instant invention remain in the well after the packing procedure is complete. The same components are then used for the production phase. Therefore, the present invention eliminates the need for a separate run with a work string and the retrieval of special tools after packing.

The present invention uses a unique service seal unit design using concentric tubing, with the inner tubing an extension of the traditional wash pipe and later acts as the production tubing. The inner tubing contains a ported sub which can be isolated at various positions within the outer tubing by way of seals located above and below the ported sub. The service seal unit can be raised and lowered on the work/production string and isolated at various positions in order to accomplish setting the packer, running a packing job, reversing out packing fluids, and receiving production fluids. No rotation is required to shift from one position to the next. The positions are located by simply raising or lowering the production string.

The invention is versatile and can be tailored to meet the requirements of each specific well completion. If some components are not desired, the system can be modified to include only those that fit a particular application. The invention provides a means for carrying screens into the well which makes it applicable to unconsolidated formations. It provides a reverse/spot position that minimizes fluid injection into the formation and allows excess slurry to be removed from the wellbore by reverse circulation. This spot/reverse position can be positively located by use of an optional indicator collet. The packer may be either permanent or retrievable and can be set without tubing manipulation or the potential that it will release during the pumping procedure.

The present invention is a great improvement over prior art methods and assemblies by eliminating the well completion step of running a packing job on a separate work string which must be run down the well and then run back up, thus exposing the well to seal problems, potential fluid loss, and using expensive rig time. Using a functionally simple design, the present invention saves rig time, eliminates sealing and fluid loss problems, and provides an economical alternative to prior art frac pack, gravel pack, and similar well completion assemblies.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 2:
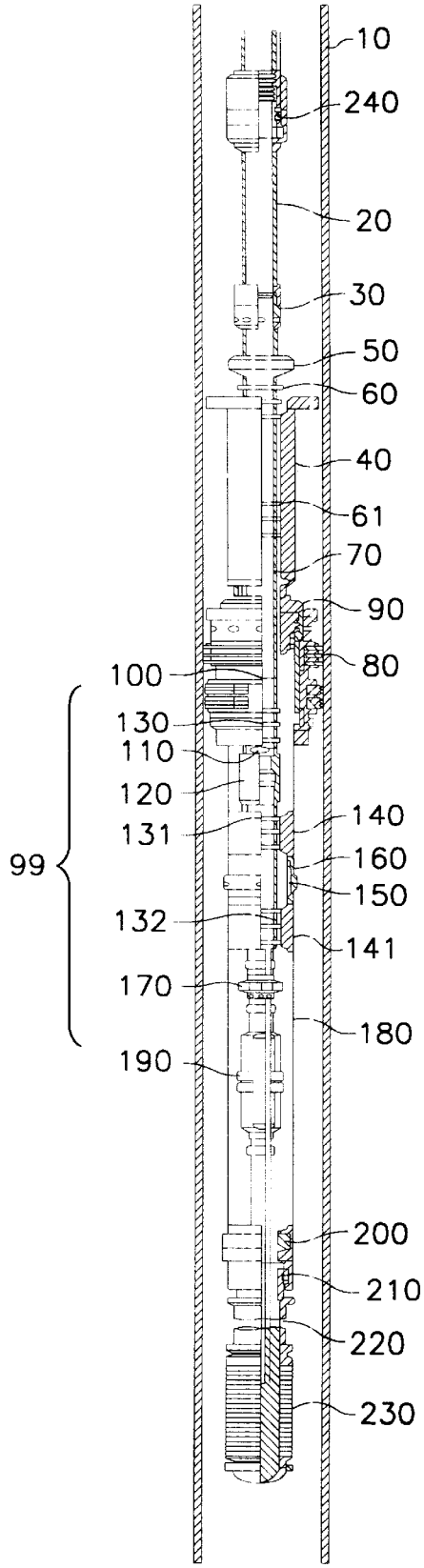
FIG. 2 is a quarter sectional view of the present invention in the run/set position.

FIG. 2 illustrates an embodiment of the present invention in the run/set position, a position that will be described in more detail after a review of the work components of the assembly illustrating the embodiment shown in FIG. 2A.

Figure 2A:
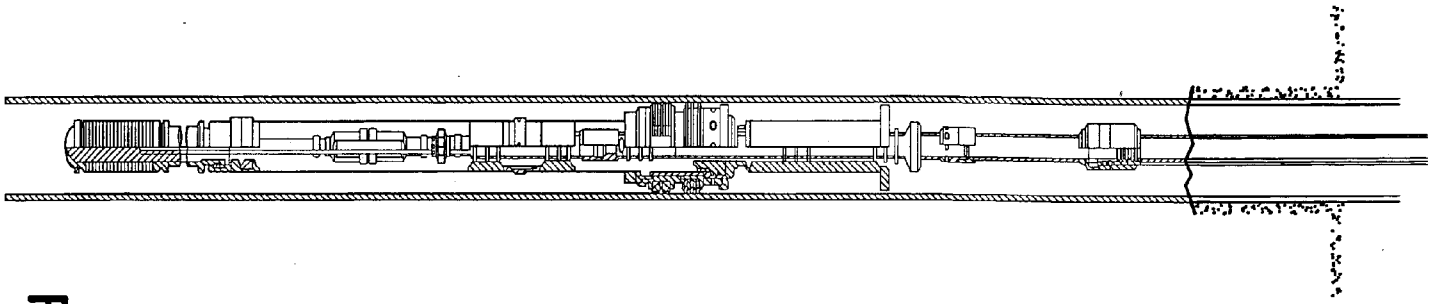
FIG. 2A is an overall view of the present invention inserted into and protruding out of a well bore.

FIGS. 2 and 2A are schematic illustrations of a gravel pack embodiment of the assembly as it appears in a well casing 10. The assembly is attached to a production string/tubing 20. Due to its sealed nature, there is no fluid entry into the tubing 20 during the running of the assembly into the well. Therefore, this embodiment incorporates a fill sub 30, which allows the tubing to be filled with fluid above the assembly level. The fill sub 30 can be pinned to shear closed at a predetermined depth/pressure. Alternatively, the tubing could be filled manually from the rig floor. The assembly includes an upper polished bore receptacle 40, which provide the means of isolating pressure from the assembly casing. Above the upper polished bore receptacle 40 on the production string 20 is a locator 50 used to set the assembly in the gravel packing position, which is the position illustrated by FIG. 4. Below the locator 50, FIG. 2 shows a first set of upper polished bore receptacle seals 60 and a second set of upper polished bore receptacle seals 61. These seals 60, 61 provide pressure seals between the exterior wall of the production string 20 and the interior wall of the upper polished bore receptacle 40.

The upper polished bore receptacle 40 is attached to a hydraulic packer 80 by a seal anchor 90. The tubing on which the upper polished bore receptacle seals 60, 61 are located is referred to as the polished bore receptacle seal assembly. The polished bore receptacle seal assembly is attached by an adapter 70 to the portion of the invention referred to as the service seal unit 99.

The service seal unit 99 is comprised of a wash pipe 100, a slurry flow sub 110, a flow diversion device 120, isolation seals 130, 131, 132, a reverse indicator 170, and a shifting device 190. The wash pipe 100 can be seen as a continuation of the production tubing and is used in the present invention as both a wash pipe for transmitting the treatment fluid and, later, part of the production tubing for the producing well. The slurry flow sub 110 is a ported sub used as a means of communicating pressure to set the hydraulic packer 80. It also offers communication so that fluids can be pumped to the casing annulus and into the formation. While FIG. 2 illustrates an embodiment with a ported sub 110, an alternative embodiment would involve the use of a sliding sleeve. This sleeve, used in conjunction with a tapered seat and drop ball, would allow an additional means to insure integrity of the gravel pack assembly position. The drop ball could be retrieved after the sand control treatment was complete. The flow diversion device 120 is preferably a ceramic disc. However, other options could be used such as a tapered seat to accept a ball or dart. With the flow diversion device 120 in place, fluid pumped down the wash pipe 100 is diverted out the slurry flow sub 110 and can not be transmitted further down stream of the wash pipe beyond the position of the flow diversion device 120. Above and below the slurry flow sub 110 are found upper and middle isolation seals 130, 131. These can be, for example, molded nitrile or a premium chevron type and are used for pressure containment above and below the slurry flow sub 110. Also shown in FIG. 2 is an optional lower isolation seal 132 which, in combination with the middle isolation seal 131, isolates the gravel pack sub 150. The reverse indicator 170 can be a positive indicator, which must be sheared to allow further upper movement of the tubing string. The reverse indicator 170 could also be a pull-through collet, which would take a pre-determined amount of tension to temporarily collapse and, thereby, allow the tubing to be moved upward. The shifting device 190 could be, for example, a multi-position collet-type or lug type device and is used to shift the closing sleeve (not shown in the illustration) in the gravel pack sub 150, thus closing the gravel pack sub ports 160.

Referring now to the components of the assembly exterior to the service seal unit 99, the gravel pack sub 150 is a ported sub that allows fluid communication to the casing annulus. As such, it offers a means of pumping fluids into the formation. It may be a ported sub or may be equipped with a closing sleeve, which isolates the ports when shifted. In the embodiment illustrated in FIG. 2, the gravel pack sub 150 shows gravel pack sub ports 160. These sub ports 160 are closed with a closing sleeve (not illustrated) which is moved in place when the service seal unit is raised, bringing the shifting device 190 in contact with the closing sleeve, thus closing the ports 160 on the gravel pack sub 150. Also shown are seal bores 140, 141, which are polished areas that provide a contact surface on which the isolation seals 130, 131, 132 pack off and contain pressure, thereby directing the flow of fluids.

The gravel pack sub 150 is connected to a lower seal bore 141. Attached to the lower seal bore 141 is a lower casing extension 180. This is a piece of casing which provides an area to house the inner components of the system and to properly space them.

Proceeding further down the assembly, FIG. 2 illustrates a mechanical fluid loss device 200. This device is preferably a ceramic frangible flapper. The mechanical fluid loss device 200 holds fluid and pressure from above (within the outer concentric tubing) and is held open by the inner concentric string. If it becomes necessary to raise the production string 20, upon pulling the end of the inner concentric string above the flapper, the fluid loss device 200 drops into the closed position. Lowering the tubing and placing weight on the flapper will break it, thus allowing access to the wellbore below. Another means of controlling fluid loss would be to use select-a-flow screens. These are screens that have a non-perforated base pipe. They can be equipped with sliding sleeves which can be opened with a shifting tool or they may be perforated to gain communication with the formation.

The lower casing extension 180 is connected to a blank 220 by an optional shear sub 210. This shear sub is used to connect the assembly to the blank and screen 230. It is shear pinned to release at a predetermined force. This device facilitates fishing and work over procedures. The blank 220 is tubing or casing that allows a reserve area above the illustrated sand control screen 230 for the slurry pumped. The screen 230 offers a means to hold the pumped proppant or sand out of the well bore and allows fluids and gas to be produced or injected through the wash pipe 100 during the production phase.

Referring back to the top of the embodiment illustrated in FIG. 2, a sub-surface safety valve 240, such as a TRSV-tubing retrievable safety valve, is shown installed on the production string 20. The safety valve 240 provides a means of shutting off oil/gas flow to the surface. This safety valve 240 may be optional equipment depending on the laws and regulations governing the location of the well and the well operator's safety requirements. If it is desirable to have a safety valve 240 installed on the production string 20 while simultaneously running the treatment, it may be necessary to run an isolation assembly in the safety valve 240. Though it is not common practice to pump a sand control treatment through a subsurface safety valve 240, it can be done depending on manufacturer specifications of the valve. Alternatively, the assembly could be run without the safety valve 240. After the treatment is pumped, enough of the tubing could be pulled to install the safety valve 240 at the proper depth. The safety valve 240 can then be installed and the tubing run back into the well and landed. Any of the above alternatives would save a great deal of rig time compared to traditional TRSV installation procedures.

Having described the major components of the system, the system is best understood by discussing the use of the embodiment illustrated (a gravel pack squeeze application) with reference to the figures showing various assembly positions. After the bridge plug or sump packer is set and the zone of interest is perforated (for example, with an electric line), the gravel pack assembly illustrated in FIG. 2 is then run down the hole on production tubing 20. The next step involves setting and testing the packer 80. This is accomplished in the run/set position illustrated by FIG. 2. The assembly is shear pinned in this position as it is run into the well or rigged in this position with some type of annular release mechanism. At this point in the gravel pack process, the production string 20 has been pressurized with the completion fluid to the level of the flow diversion device 120 either by in flow via the fill sub 30 or by filling the tubing from the rig level. Consequently, the fluid pressure is transmitted through the slurry flow sub 110 and is contained between the second set of upper polished bore receptacle seals 61 and the middle isolation seal 131. This transmitted pressure "sets" the hydraulic packer 80. After being set, the hydraulic packer 80 seals the well casing 10, thereby directing well flow to down-hole tubing conduits.

Figure 4:
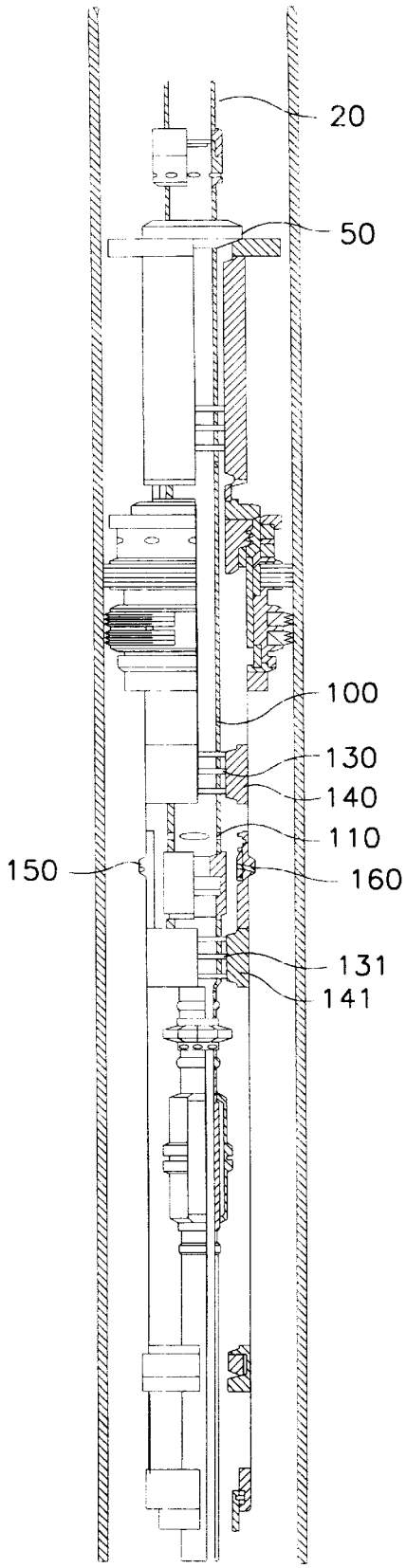
FIG. 4 is a quarter sectional view of the present invention in the gravel packing position.
Figure 1:
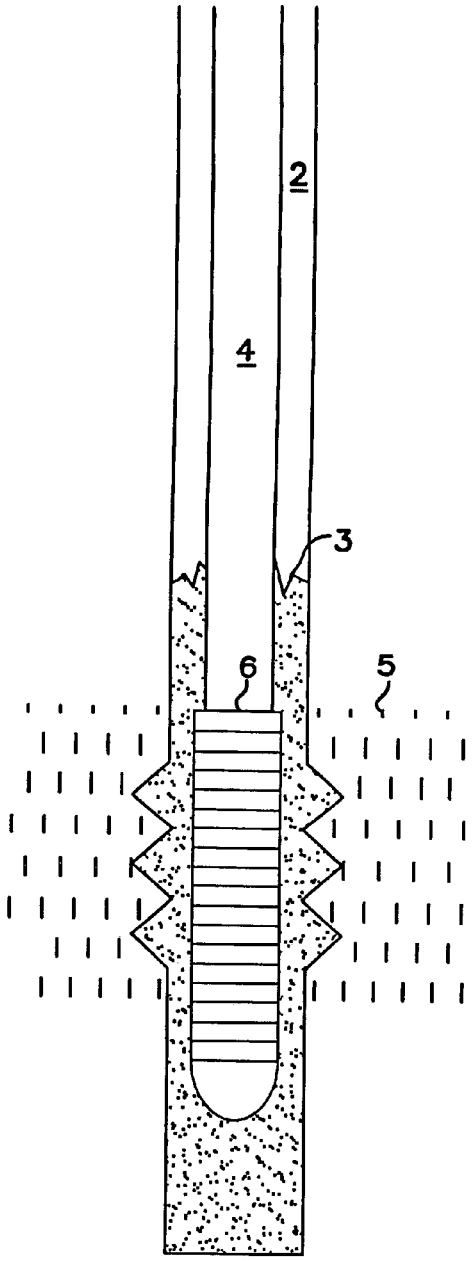
FIG. 1 PRIOR ART

The packer 80 seal is then tested by pulling up the production string 20 if necessary to shear the running pins, lowering the tubing to the gravel pack position illustrated by FIG. 4, and then closing the annular preventer (a means to seal the casing annulus) and testing the casing annulus. The various positions should also be located and marked at this stage. The gravel packing position, illustrated by FIG. 4, is located primarily by two indicators. First, weight on the production string 20 is reduced once the locator 50 seats on the upper end of the upper polished bore receptacle 40. In addition, if the well is taking fluid, this may be observed in the tubing 20 as the slurry flow sub 110 becomes isolated within the open gravel pack sub 150 and communication is established with the reservoir.

Figure 3:
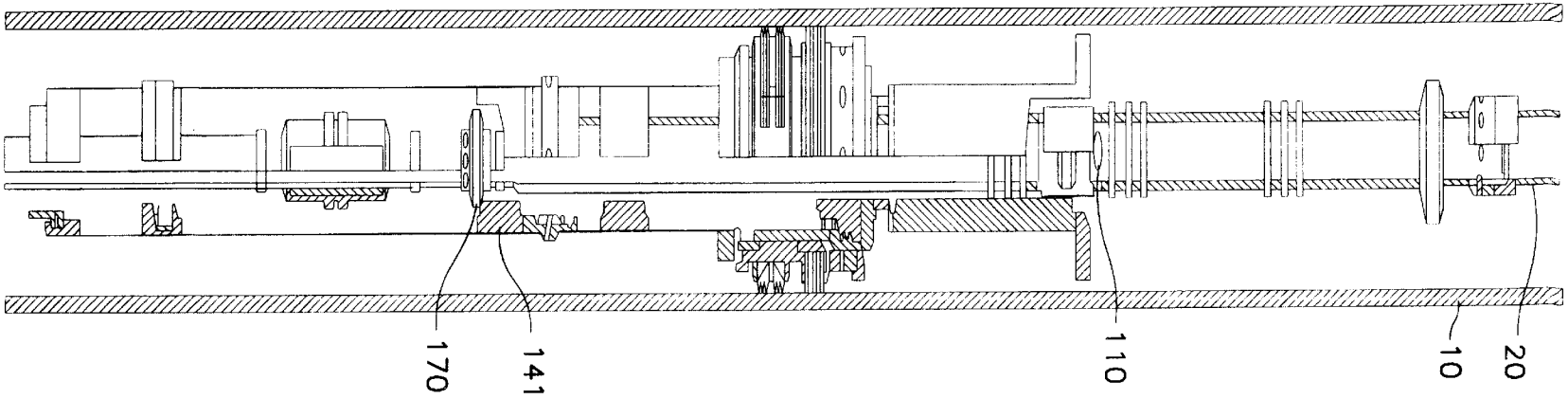
FIG. 3 is a quarter sectional view of the present invention in the reverse/spot position.

The reverse/spot position is located through several methods. First, as illustrated in FIG. 3, the reverse indicator 170 comes into contact with the lower seal bore 141, thereby indicating increased weight on the production string 20. Second, the distance between the position of the slurry flow sub 110 in the original pinned position illustrated by FIG. 2 and the reverse position illustrated in FIG. 3 can be predetermined and confirmed by pulling a like length of production string 20 out of the wellbore. Additionally, if pressure is applied to the casing annulus with the preventer closed, once the slurry flow sub 110 is pulled above the upper polished bore receptacle 40 a pressure drop will be shown at the rig level as the completion fluid in the well casing 10 comes into communication with the production string 20. Finally, in the position illustrated by FIG. 3, circulation in either direction is established and conclusively verifies the reverse/spot position. At this time the production string could also be marked at the rig level for easy visual identification of the reverse/spot position. The production string could also have been previously marked at rig level while the production string was in the run/set position for easy location of this position after well completion. As will be explained further below, the reverse/spot position is typically used to reverse out completion fluids, while the run/set position can be used in the production phase.

Once all positions are marked and located, the gravel pack phase can begin. The assembly is placed in the position shown by FIG. 3 to spot the treatment, then shifted to the position shown in FIG. 4. The gravel pack sub ports 160 are initially rigged in the open position. Once the upper isolation seal 130 and middle isolation seal 131 properly seat with their respective seal bores 140, 141, the fluid pressure is transmitted through the slurry flow sub 110 and into the casing annulus through the gravel pack sub ports 160. Once located in this position, the pumping of fluids for the sand control job can be accomplished, thereby filling the well annulus and surrounding the screen 230 with the packing gravel.

After the gravel pack stage is complete, the next step involves the reverse out stage, when the production string is again raised to the reverse/spot position illustrated by FIG. 3. Completion fluid in the annulus is reverse circulated through the slurry flow sub 110 up the production tubing 20 until returns are sand free.

A space out of the production string 20 can then be performed by replacing the top section of the production string 20 at the rig level with shorter tubing lengths corresponding with the proper production string 20 length for the production phase. If it is necessary to install a sub-surface safety valve 240, the production string 20 can be pulled to install such device. When raising the production string 20 for this purpose the wash pipe 100 is correspondingly raised above the mechanical fluid loss device 200. The flapper in the mechanical fluid loss device 200 then drops, thereby isolating the blank 220 and screen 230 from the rest of the assembly and precluding the seepage of fluids from of above. After installing the subsurface safety valve, the production string 20 is then run back into the hole and landed. As the production string 20 is run back into the well, the bottom of the wash pipe 100 will come into contact with the flapper on the mechanical fluid loss device 200. The weight of the production string 20 on the flapper will break it, thereby allowing access to the wellbore below. Pressure is then applied down the production string tubing 20 to confirm the space out.

After placing the system in the run/set position illustrated by FIG. 2, the diversion device 120 is broken to allow production fluids to enter the screen 230 and proceed up the wash pipe 100. The closing sleeve has since been shifted closed. Thus, the gravel pack sub 150 is isolated by isolation seals 131, 132 and is closed to communication with the annulus. The slurry flow sub 110 is again isolated between the second set of upper polished bore seals 61 and the middle isolation seal 131. Consequently, the production fluids continue up the production tubing 20.

The well could also produce from the gravel packing position shown by FIG. 4. The slurry flow sub 110 is now isolated between the upper isolation seal 130 at the upper seal bore 140 and the middle isolation seal 131 at the lower seal bore 141. The slurry flow sub 110 is also isolated from the casing annulus by the closing sleeve in the gravel pack sub 150 which has since been shifted closed.

Although preferred embodiments of the present invention have been described in the foregoing description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

I claim:

1. An apparatus for use in both gravel packing and capturing production fluids from a wellbore having an annulus, said apparatus comprising:

an inner tubing string having a lower section placed within the annulus;

an outer tubing assembly containing and concentric with the lower section of the inner tubing string;

a seal between the lower section of the inner tubing string and the outer tubing assembly;

at least one port on the inner tubing string for communicating a first fluid between the inner tubing string and the outer tubing assembly;

at least one port on the outer tubing assembly for communicating the first fluid between the outer tubing assembly and the wellbore annulus;

means for selectively communicating a second fluid between the wellbore annulus and the lower section of the inner tubing string;

wherein the inner tubing string can be raised or lowered within the wellbore while the outer tubing assembly remains fixed within the wellbore;

wherein said raising and lowering of the inner tubing string within the outer tubing assembly selectively positions the inner tubing string relative to the outer tubing assembly such that:

(a) in a first position, the first fluid is directed via the inner tubing string through said at least one port in the inner tubing string and said at least one port in outer tubing assembly to the wellbore annulus; and (b) in a second position, the second fluid may flow from the wellbore annulus to the inner tubing string via said fluid communication means.

2. The apparatus of claim 1 wherein the outer tubing assembly further comprises a seal between the outer tubing assembly and the wellbore annulus.

3. The apparatus of claim 1 wherein the outer tubing assembly further comprises a filtering screen between the lower section of the inner tubing string and the wellbore annulus.

4. The apparatus of claim 1 wherein the lower section of the inner tubing string is initially attached in a fixed position relative to the outer tubing assembly when placed into the wellbore annulus.

5. The apparatus of claim 1 wherein the at least one port on the inner tubing string is selectively isolated in different positions within the outer tubing assembly and the wellbore annulus as the inner tubing is raised and lowered.

6. The apparatus of claim 1 wherein the port on the outer tubing assembly can be closed by a closing device activated by raising the inner tubing string.

7. The apparatus of claim 1 wherein the inner tubing string interchangeably transports completion, wash, and production fluids.

8. The apparatus of claim 1 wherein the means for selectively communicating the second fluid between the wellbore annulus and the lower section of the inner tubing sting further comprises a frangible flow diversion device below the inner tubing string port.

9. The apparatus of claim 1 wherein the outer tubing assembly further comprises:

an upper polished bore receptacle;

a hydraulic packer attached to said upper polished bore receptacle;

a gravel pack sub attached to said hydraulic packer; and, a screen attached to said gravel pack sub.

10. The apparatus of claim 1 wherein the first fluid is a slurry comprised of a proppant and a carrier fluid; and the second fluid is comprised of production fluids produced by a formation.

11. The apparatus of claim 1 wherein, in a third position, the flow of the first fluid may be reversed circulated through the at least one port in inner tubing string and up the inner tubing string.

12. An apparatus for use in both gravel packing and capturing production fluids from a wellbore having an annulus, said apparatus comprising:

an inner tubing string having an upper end protruding above the wellbore, a lower end within the annulus, and a lower section placed within the annulus;

said lower section of inner tubing string has at least one port for communicating fluids out of and into the inner tubing string and a diversion means below said at least one port;

an outer tubing assembly having an upper end and a lower end and further containing and concentric with the lower section of the inner tubing string;

said outer tubing assembly further comprising at least one port between said upper end and lower end for communicating fluid out of and into the outer tubing assembly;

a seal between the lower section of the inner tubing string and the outer tubing assembly;

a seal between outer tubing assembly and the wellbore annulus;

wherein the inner tubing string can be raised or lowered within the wellbore while the outer tubing assembly remains fixed within the wellbore;

wherein said raising and lowering of the inner tubing string within the outer tubing assembly selectively positions the inner tubing string relative to the outer tubing assembly such that:

(a) in a first position, a first fluid is directed via the inner tubing string through said at least one port in the inner tubing string and said at least one port in outer tubing assembly to the wellbore annulus; and (b) in a second position, a second fluid may flow from the wellbore annulus to the inner tubing string.

13. The apparatus of claim 12 wherein said diversion means comprises a frangible device.

14. The apparatus of claim 12 further comprising a closing device on the port of said outer tubing assembly.

15. The apparatus of claim 12 wherein the inner tubing string is initially attached in a fixed position relative to the outer tubing assembly when placed into the wellbore annulus.

16. The apparatus of claim 12 wherein the lower section of the inner tubing further comprises a reverse indicator.

17. The apparatus of claim 12 wherein the upper end of the outer tubing assembly further comprises an upper polished bore receptacle.

18. The apparatus of claim 12 wherein the seal between the outer tubing assembly and the wellbore annulus is a hydraulic packer.

19. The apparatus of claim 12 wherein the outer tubing assembly further comprises a mechanical fluid loss device.

20. The apparatus of claim 12 further comprising a screen assembly attached to said lower end of the outer tubing assembly.

21. The apparatus of claim 12 wherein the first fluid is a slurry comprised of a proppant and a carrier fluid; and the second fluid is comprised of production fluids produced by a formation.

22. The apparatus of claim 12 wherein, in a third position, the flow of the first fluid may be reversed circulated through the at least one port in inner tubing string and up the inner tubing string.

23. The apparatus of claim 12 wherein the outer tubing assembly further comprises a filtering screen between the lower section of the inner tubing string and the wellbore annulus.

24. The apparatus of claim 12 wherein the at least one port on the inner tubing string is selectively isolated in different positions within the outer tubing assembly and the wellbore annulus as the inner tubing is raised and lowered.

25. The apparatus of claim 12 wherein the inner tubing string interchangeably transports completion, wash, and production fluids.

* * * * *

UNITED STATES PATENT AND TRADEMARK OFFICE

CERTIFICATE OF CORRECTION

PATENT NO. : 6,241,013 B1
DATED : June 5, 2001
INVENTOR(S) : William J. Martin

Figure 1:
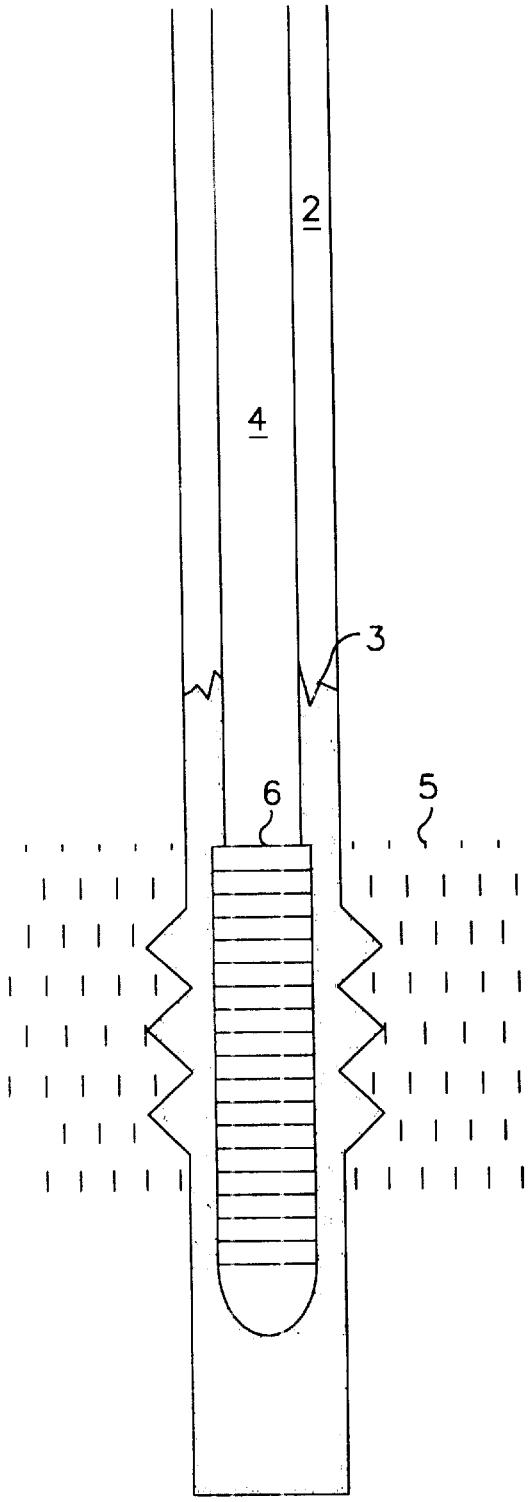
FIG. 1 is a schematic representation of a prior art gravel pack completion.

It is certified that error appears in the above-identified patent and that said Letters Patent is hereby corrected as shown below:

Drawings,
Sheets 1 and 3 of 4, consisting of Figs. 1 and 2A, should be deleted and replaced with the corrected Figs. 1 and 2A, as shown on the attached pages.

Signed and Sealed this

Eighteenth Day of June, 2002

*Attest:*

*Attesting Officer*

JAMES E. ROGAN
*Director of the United States Patent and Trademark Office*